United States Patent [19]

Stanton

[11] 4,399,845

[45] Aug. 23, 1983

[54] DISPENSING METHOD AND APPARATUS

[75] Inventor: Taki Stanton, Mount Waverley, Australia

[73] Assignee: Universal Nominees Pty. Ltd., Richmond, Australia

[21] Appl. No.: 266,009

[22] Filed: May 21, 1981

Related U.S. Application Data

[63] Continuation of Ser. No. 76,992, Sep. 19, 1979, abandoned.

[30] Foreign Application Priority Data

Sep. 29, 1978 [AU] Australia ..... PO6159

[51] Int. Cl.[3] ..... B65B 3/34; B65B 43/58

[52] U.S. Cl. ..... 141/1; 53/56; 53/266 R; 141/172; 141/173; 141/280

[58] Field of Search ..... 141/1, 89, 125, 280, 141/281, 283, 284, 173, 172, 131, 183; 53/56, 266 R

[56] References Cited

U.S. PATENT DOCUMENTS 2,612,016 9/1952 Anderson .
3,124,916 3/1964 Anderson et al. .
3,172,435 3/1965 Anderson et al. .
3,364,651 1/1968 Stohlquist .

FOREIGN PATENT DOCUMENTS 139674 2/1948 Australia .
230816 11/1959 Australia .
234127 11/1959 Australia .
442345 12/1971 Australia .
501863 3/1939 United Kingdom .
1032558 6/1966 United Kingdom .

*Primary Examiner*—Frederick R. Schmidt
*Attorney, Agent, or Firm*—Fleit, Jacobson & Cohn

[57] ABSTRACT

A method and apparatus for dispensing plastic material from an extruder into a container; "plastic material" being a material sufficiently viscous to enable dispensation by severing, for example ice-cream, grease, margine or the like. The plastic material is extruded through an extruder opening having a flange therearound and the container is firstly raised to a position whereat the plastic material is downwardly extruded thereinto, whereafter the container and the extruder are relatively moved so that the container opening and peripheral edge thereof are moved across the extruder opening and flange, thereby severing the plastic material away from the extruder.

17 Claims, 5 Drawing Figures

DISPENSING METHOD AND APPARATUS

This is a continuation of application Ser. No. 76,992 filed Sept. 19, 1979 now abandoned.

BACKGROUND OF THE INVENTION

The present invention relates to the severing of plastic material expelled from an extruder and the placement of the plastic material so severed, into a container. The present invention particularly relates to plastic material such as ice-cream, margarine or grease.

Hereinafter, it should be understood that the term "plastic material" is intended to mean a material which is so viscous that on the one hand it may be made to behave as a pliable solid which may be cut or severed, whereas on the other hand it may be caused to flow or be extruded as a plug by application of sufficient flow or extrusion pressure.

In the past, packaging of plastic material such as ice-cream into a container has been achieved by a number of different devices.

One such prior art device comprises a cylinder and piston which together meter and deliver ice-cream. In this device the cylinder is filled with ice-cream to a capacity which is metered by the displacement of the piston in the cylinder whereafter the ice-cream is delivered from the device into a container. Unfortunately such devices tend to be slow and have a capacity which is limited to that allowed by the maximum displacement of the piston in the cylinder.

A more preferred prior art arrangement has utilized an extruder to expel a cylindrical plug of ice-cream therefrom together with a separate cutting device which severs the plug from the extruder. As the extruder may be fed by one or more ice-cream manufacturing machines, such an arrangement is quite flexible in terms of capacity. The cutting device which consists of opposed blades which are scissored together to effect severance, is operated at timed intervals so enabling the plug severed from the extruder to fall therefrom into a suitably located container. Unfortunately, the plug so formed does not usually conform to the shape of the container and a subsequent pressing operation is required to evenly distribute the ice-cream within and across the container.

It would be desirable to devise a method and apparatus for delivering plastic material, such as ice-cream, margarine or grease, into a container by means of an extruder, which method and apparatus would entirely eliminate the need for a cutting device and which method and apparatus would also evenly distribute the plastic material across the container.

SUMMARY OF THE INVENTION

In one aspect the present invention provides a method for dispensing plastic material into a container, said container having a container opening, said plastic material being expelled from an extruder having an extruder opening; said method including:

locating said container opening and said extruder opening so as to enable plastic material extruded through said extruder opening to pass through said container opening, whereafter relative movement of said container opening across said extruder opening is effected so severing the plastic material extruded through said extruder opening away therefrom into said container.

In another aspect the present invention provides a plastic material dispensing apparatus for dispensing plastic material into a container, said container having a container opening, said apparatus comprising:

an extruder having an opening, and a container positioning and actuating means, said positioning and actuating means being adapted to position a container relative to said extruder so as to enable plastic material extruded through said extruder opening to pass through said container opening, said positioning and actuating means and said extruder being movable relative to each other so that said container opening is moved across said extruder opening to thereby sever plastic material extruded through said extruder opening into said container.

In still another aspect the present invention provides a plastic material dispensing apparatus for dispensing plastic material into a container, said container having a container opening, said apparatus comprising:

an extruder having an opening, a positioning means for positioning said container, and a first actuating means for relatively moving said container and said extruder openings;

whereby, in use, said positioning means positions a container relative to said extruder so as to enable plastic material extruded through said extruder opening to pass through said container opening, whereafter said first actuating means relatively moves said container across said extruder opening thereby severing plastic material extruded through said extruder opening away therefrom into said container.

A preferred embodiment of the present invention will now be described hereinafter with reference to dispensing ice-cream into ice-cream containers as shown in the accompanying drawings in which:

FIG. 1 is a plan view of an ice-cream extruding station,

FIG. 2 is a part-sectional side view from the direction of arrows 2—2 in FIG. 1, FIG. 3 is a sectional view along arrows 3—3 in FIG. 2, FIG. 4 is a sectional view of an ice-cream container showing the even fill of the ice-cream container achieved by the apparatus of FIGS. 1 to 3, and FIG. 5 is a plan view similar to FIG. 1 showing an alternative arrangement for achieving the relative movement of ice-cream containers across or away from the ice-cream extruder.

DETAILED DESCRIPTION

Figure 1:
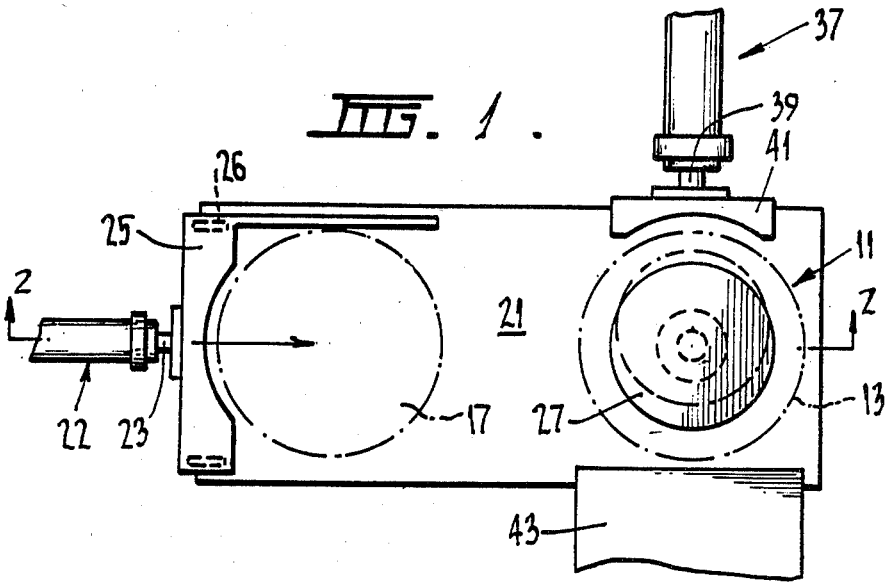
Figure 2:
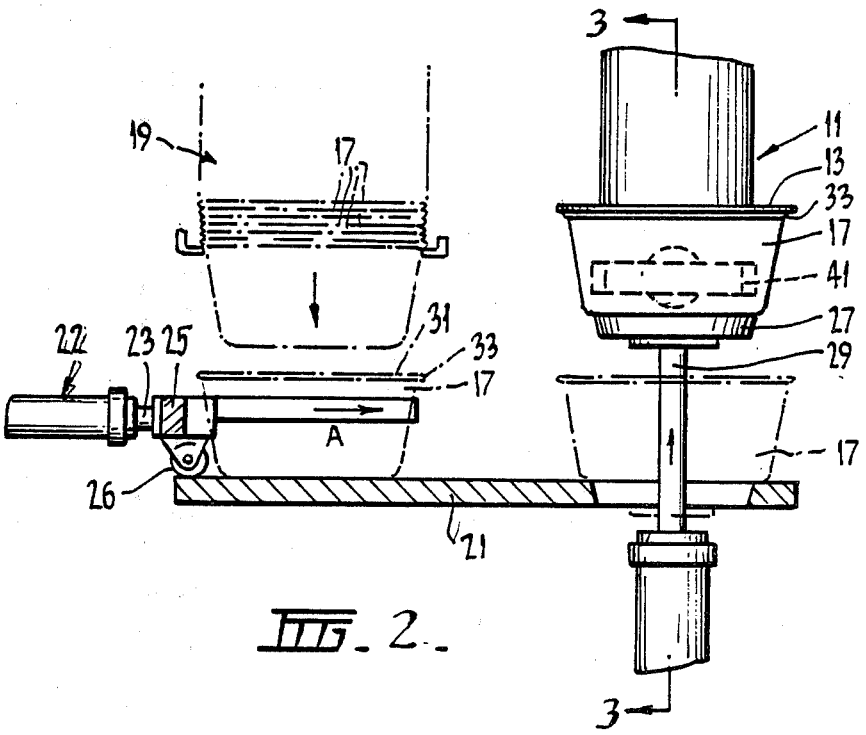

Referring to FIGS. 1 and 2 there is shown a downwardly facing ice-cream extruder 11 having an abuttment means in the form of a flange 13. Ice-cream manufactured in a separate machine (not shown) is pumped into extruder 11 and is continuously expelled downwardly through extruder opening 15.

Figure 3:
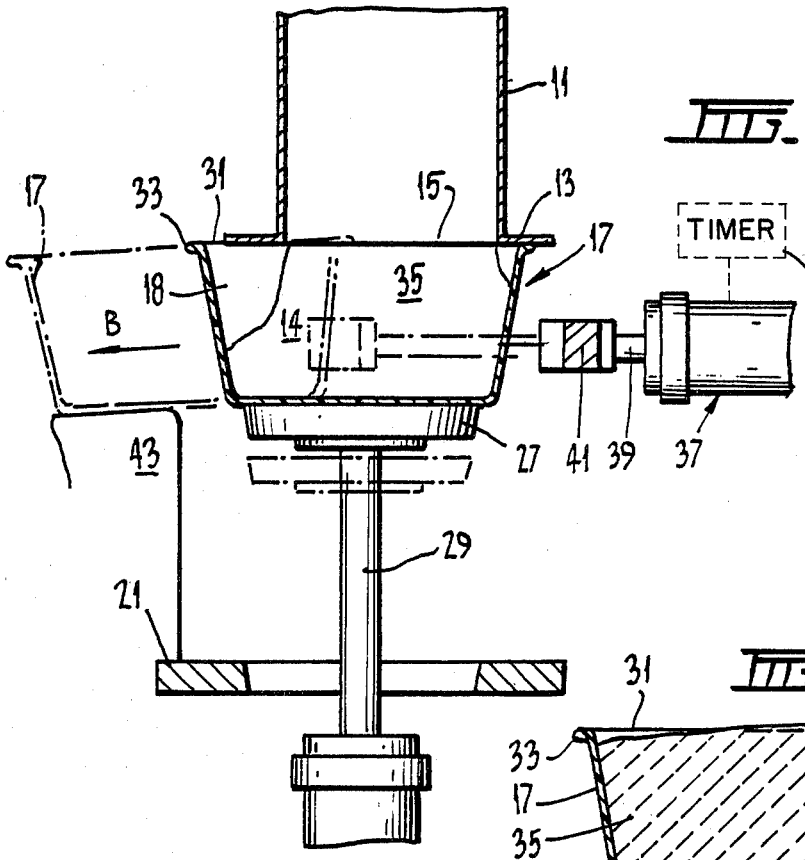

Individual containers, such as container 17, are separated from a supply 19 thereof consisting of a stacked vertical column of individual containers and are dropped on to a table 21 at a location beneath and to the left (relative to FIGS. 1 and 2) of extruder 11. From this location, an actuating member 22 comprising a pneumatically operated piston 23 and a container engaging and guiding member 25 having a roller 26, slides said container 17, in the direction of arrow A, along table 21 to a position which both overlies a lift platform 27 and is below extruder 11. This position is shown by the container shown on the right hand side of table 21 in FIG. 2. From this position lift platform 27, which includes a pneumatically operated piston 29, raises container 27 from table 21 to the position shown in FIGS. 2 and 3 which will enable plastic material being expelled from extruder 11 to pass through container opening 31 as shown in FIG. 3. Alternatively, (not shown) instead of raising container 17 to extruder 11, extruder opening 15 may be lowered down to container 17.

Figure 4:
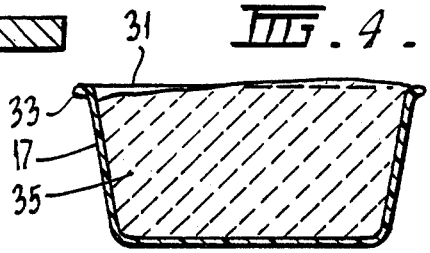

As seen in FIGS. 2, 3 and 4 container 17 is cupshaped with an opening 31, defined by a peripheral edge 33, which has a diameter which is at least equal to or larger than extruder opening 15.

Referring to FIGS. 2 and 3 it can be seen that lift 27 raises container 17 to a position where extruder opening 15 and container opening 31 are in registration whereby plastic material such as ice-cream 35 which is downwardly expelled from extruder 11 in the form of a plug (not shown), passes through container opening 31 and is received in container 17. It should be understood that ice-cream 35 is continuously expelled through extruder opening 15 so that ice-cream which is expelled during the period after the severing operation up until the time when the container 17 is located beneath extruder 11 as seen in FIGS. 2 and 3, together with ice-cream 35 subsequently expelled after container 17 is located beneath extruder 11, collects in container 17 until such time as a severing operation is commenced.

The operation of lift 27 is controlled so that the peripheral edge 33 of container 17 is raised to a position where peripheral edge 33 abuts flange 13 thereby enabling the movement of container 17 relative to extruder 11 to slidingly move peripheral edge 33 across flange 13 so severing ice-cream away from extruder 11. It should be understood that the abutment of peripheral edge 33 and flange 13 and the subsequent movement desirably, but not necessarily, involves actual sliding contact thereof. In fact severing may be effected where a gap exists between peripheral edge 33 and flange 13, however, a close abutment with sliding is desirable to minimize spillage of ice-cream. Additionally flange 13 assists in vertical positioning of the peripheral edge 33, so that this edge is not raised to a position above opening 15, such a position would prevent the relative movement required for severing since the side wall 18 of container 17 would prevent the relative movement of container opening 31 across extruder opening 15. Thus flange 13 assists in assuring that container 17 is not raised too far by blocking the upward movement of container 17 and by providing a ready datum as to the extent of necessary upward movement of piston 29.

Additionally it should be noted that clean severing of the ice-cream away from extruder 11 is contributed too by the speed with which the relative movement is effected.

Referring again to FIG. 3, the relative movement of container 17 across extruder 11 (part of which is shown by ghosted lines in FIG. 3) is effected by actuating member 37, which consists of piston member 39 and container engaging member 41. The relative movement moves container 17 in the direction of arrow B (i.e. horizontally to the left as seen in FIG. 3) thereby moving container opening 31 across extruder opening 15 whereby the peripheral edge 33 of container opening 31 severs the ice-cream which has already been expelled through opening 15 into container 17 and away from the remainder of the ice-cream within extruder 11. During this relative movement container 17 initially slides upon lift platform 27, however a point is reached, shown by the dotted lines in FIG. 3, where container 17 is solely supported by being held between engaging member 41, flange 13 and receiving platform 43. Consequently as container 17 is no longer supported by lift platform 27, piston 29 may then be actuated to withdraw platform 27. Consequently as platform 27 is not required during the whole of the severing operation the speed of the overall operation may be enhanced.

Additionally, during severing, flange 13 assists in distributing the severed ice-cream across container 17. The even distribution may be seen by reference to FIG. 4. The complete execution of the relative movement by actuator 37 results in displacement of container 17, in the direction of arrow B of FIG. 3, from its position upon lift 27 to a position (not shown) upon ramp 43 which acts as a receiving station for filled containers.

Referring again to FIG. 3 it should be noted that for one particularly preferred mode of operation, container 17 is positioned so that the right-hand side of the periphery thereof abuts flange 13 and so that the left-hand side periphery is clear of flange 13. This positioning contributes to the achievement of the fill distribution shown in FIG. 4, i.e. a fill having a depth slightly less than that of the container at one side thereof and a fill which is slightly greater than the depth of the container in the region of the opposite side thereof.

Figure 5:
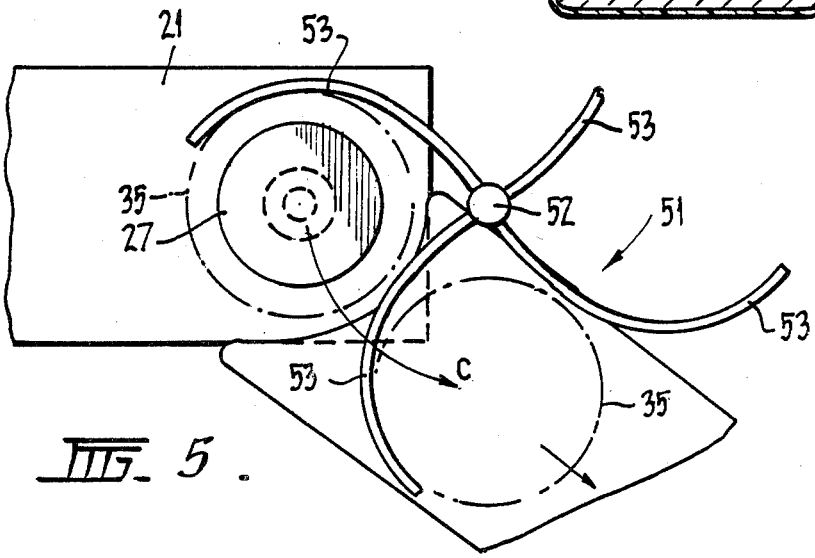

It can be readily appreciated that after the above described severing operation, actuator 37 must be retracted before the next severing operation can be commenced. The time elapsing during this retraction may undesirably increase the time between such severing operations.

Where a higher speed of operation than can be achieved by actuator 37 of FIGS. 1 to 3 is desired, the actuator 51 which is shown in FIG. 5 may be used in place of actuator 37.

Actuator 51 comprises a shaft 52 from which four curved arms 53 radially extend. Rotation of actuator 51 through approximately 90° enables an arm 53 to engage container 17 and effect relative movement of container 17 with respect to extruder 11, i.e. a movement in the direction of arrow C of FIG. 5, to thereby effect severing. As can be readily appreciated from FIG. 5, each 90° rotation successively places another blade 53 into a position wherefrom it can relatively move a container 17 across extruder opening 15. Consequently with actuator 51 there is no retracting movement, as is the case for actuator 37, since blades 53 are returned to the position from which they effect severing by the continued rotation of actuator 51 in the same anti-clockwise direction.

Preferably ice-cream is expelled from extruder 11 at a constant rate thereby enabling the severing operation to be performed at constant intervals controlled by a timer T.

In an alternative embodiment of the present invention (not shown) the above described members comprising actuating member 22, lift 27 and actuating members 37 or 51 may all be replaced by a single actuator which either clasps a container 17 delivered thereto or correspondingly effects movement of extruder 11 so that, in a manner analogous to the movements of actuator 22, lift 27 and actuator 37 respectively; container 17 is relatively positioned underneath extruder 11, container 17 and extruder 11 are then brought to a position whereat ice-cream is delivered into container 17 and wherefrom relative movement between extruder opening 15 and container opening 31 then enables peripheral edge 33 to move across flange 13 so severing expelled ice-cream away from extruder 11 into container 17. Thereafter the container 17 and extruder 11 are separated and container 17 is delivered to a suitable receiving station. The single actuator can then be returned to its starting location in order to repeat the above described cycle.

From the above description of different embodiments of the present invention, it is clear that it is relative movement of the extruder and container which effects the severing, this relative movement being common to each of the different embodiments of the invention. It should also be clear that the relative movement can be effected by moving either the container, or the extruder, or both.

Where high speed explusion of ice-cream is desired from extruder 11 whilst retaining the use of actuator 37 of the embodiment of FIGS. 1 to 4, or after the severing movement of the actuator of the above described alternative embodiment, the return movement should be effected so as to avoid contact with the ice-cream which continues to be expelled from the extruder 11. One means of achieving this in the apparatus of FIGS. 1 to 3 is to rapidly retract actuator 37 before the ice-cream continuing to be expelled from extruder 11 extends far enough down below extruder 11 to come into contact with actuator 37. Alternatively, the actuator 37, after its severing movement, may be moved laterally away from extruder 11 so that the return movement of the actuator does not interfere with ice-cream continuing to be expelled through the extruder opening 15.

The above described preferred embodiments of the present invention result in a number of advantages.

In FIGS. 1 to 5 the largest size of container which is usually commercially required is shown in use. However a number of smaller size containers are also commonly required. It can readily be appreciated that the lesser diameters of smaller containers are readily accommodated by the width of the flange 13 and the only change to the apparatus of FIGS. 1 to 5 to accommodate such smaller containers would be an adjustment of the lift so that the periphery of the smaller container is raised to the required position enabling severing, and adjustment of the timing of the container fill, to allow for the different filling times for the smaller containers.

Such ready adaption of apparatus to different container sizes is not so readily realized in prior art devices.

Additionally the nature of the severing operation results in an evenly distributed fill around the circumference of the container and this even fill is vertically distributed with a slightly greater depth at one side of the container than at the other, as seen in FIG. 4. This fill distribution may be advantageously utilized during lidding of container 17.

The above description of different preferred embodiments of the present invention has been given, by way of example only, with reference to the dispensation of ice-cream into ice-cream containers. It should be understood, however, that the present invention is not limited to ice-cream dispensation but relates to the dispensation of any suitable plastic material susceptible to the defined severing operation by relative movement of container and extruder openings.

As modifications within the spirit and scope of the present invention may be readily effected by persons skilled in the art, it should be understood that the present invention is not limited to the preferred embodiments hereinabove described.

What is claimed is:

1. A method for dispensing plastic material into a container through its top, said container having a peripheral top edge defining a container opening, said plastic material being expelled from an extruder having an extruder opening oriented downwardly and provided with a flange therearound, said method comprising:

extruding plastic material from said extruder at a substantially uniform rate;

raising said container from a position spaced below the extruder into a position in which at least a portion of the peripheral edge of the container is in abutment with the extruder flange;

maintaining the peripheral edge in abutment with the extruder flange and maintaining the extruder opening in a fixed position so as to enable plastic material extruded through said extruder opening to pass into said container through said opening; and moving said container in a substantially horizontal direction at a spaced interval controlled by a timer to thereby sever plastic material extruded through said extruder opening away therefrom into said container, the spaced interval being a function of the rate of extrusion of the plastic material.

2. A method according to claim 1, wherein said horizontal moving is commenced when the volume of material extruded through said extruder opening corresponds to a substantially complete fill of said container.

3. A method according to claim 1, wherein the size of the container opening is larger than the size of the extruder opening, and wherein material is extruded into said container to a level higher than the peripherl edge of the container.

4. A method according to claim 1 further comprising positioning the container below the extruder with the center of the container off-set from the center of the extruder opening so that when the container is raised into abutment with the extruder flange and receives extruded material the fill depth on one side of the container is less than the height of the container and less than the fill depth in the remainder of the container.

5. A dispensing apparatus for dispensing plastic material into a container having a peripheral top edge defining a container opening, said apparatus comprising:

extruder means for extruding plastic material at a substantially uniform rate, said extruder means, during a dispensing operation, having a stationary downwardly open extruder opening surrounded by a stationary flange;

first means for horizontally moving a container into a position wherein the container opening is aligned with and positioned below the extruder opening;

means for vertically moving the container so that at least a portion of the peripheral edge thereof abuts the flange of the extruder means and for holding the peripheral edge in abutment with the flange during filling of the container so that material enters the container from the extruder opening, the extruder opening being positioned at a level higher than the container opening throughout the dispensing operation;

second means for horizontally moving a container away from said extruder opening to thereby sever plastic material extruded through said extruder opening away from said extruder means;

timing means for controlling said second means so that containers are moved away from said extruder means at spaced intervals determined by the rate of material extrusion;

and a receiving station for receiving a container from said second means.

6. The apparatus of claim 5, wherein said means for vertically moving and for holding comprises a lift platform for supporting and raising a container from below.

7. The apparatus of claim 6, wherein said means for vertically moving and for holding comprises a pneumatically operated piston and cylinder assembly connected to said lift platform.

8. The apparatus of claim 7, wherein said first means comprises a pneumatically operated piston having a container engaging and guiding member, and wherein said second means comprises a piston having a container engaging member.

9. The apparatus of claim 6, further comprising a table positioned below said extruder means, said first means sliding the container along the table onto said lift platform.

10. The apparatus of claim 6, wherein said receiving station is positioned to receive and support a container after said second means has advanced the container a predetermined distance so that the lift platform can be lowered while said second means is still moving the container.

11. The apparatus of claim 5, wherein said second means comprises at least one arm extending radially from a drive shaft whereby rotation of said shaft propels said arm which in turn effects said movement of said container.

12. The apparatus of claim 11, wherein said second means comprises four substantially evenly spaced arms whereby each rotation of said shaft through approximately 90° effects successive relative movements of containers.

13. The apparatus of claim 5, wherein said second means comprises a member contacting said container that is extended across said extruder opening and is then retracted in a manner such that it does not come into contact with plastic material continuing to be expelled from said extruder opening.

14. The apparatus of claim 5, wherein said second means comprises a member contacting said container that is retracted immediately after extension thereof whereby retraction is effected before the plastic material continuing to be expelled from said extruder means opening can come into contact with said member.

15. A dispensing apparatus for dispensing semisolid ice cream into a container having a peripheral edge defining a container opening, said apparatus comprising:

extruder means for extruding semisolid ice cream at a substantially uniform rate, said extruder means, during a dispensing operation, having a stationary downwardly open extruder opening surrounded by a stationary flange;

first means for horizontally moving a container into a position wherein the container opening is aligned with and positioned below the extruder opening;

means for vertically moving the container so that at least a portion of the peripheral edge thereof abuts the flange of the extruder means and for holding the peripheral edge in abutment with the flange during filling of the container so that semisolid ice cream enters the container from the extruder opening, the extruder opening being positioned at a level above the container opening throughout the dispensing operation;

second means for horizontally moving a container away from said extruder opening to thereby sever semisolid ice cream extruded through said extruder opening away from said extruder means;

timing means for controlling said second means so that containers of semisolid ice cream are moved away from said extruder means at spaced intervals determined by the rate of extrusion; and a receiving station for receiving a container from said second means.

16. An apparatus for filling a container with ice cream comprising:

a stationary ice cream extruder having a downwardly facing extruder opening and a peripheral flange coplanar with, encompassing and extending outwardly from the extruder opening;

means for continuously expelling ice cream through said extruder opening at a constant rate;

means for separating individual ice cream containers from a supply of containers and for positioning the separated containers vertically below said extruder opening, each of said containers having an upper peripheral edge defining a filling opening with a cross-sectional area greater than the cross-sectional area of said extruder opening;

means for vertically raising each of said separated containers so that the container peripheral edge abuts the extruder peripheral flange and for holding the container in contact with the flange, the peripheral flange limiting upward movement of the container;

severing means for horizontally moving each of said raised containers so that the container upper edge slides across the extruder flange thereby severing ice cream in the container from ice cream being extruded; and timing means for actuating said severing means at constant time intervals.

17. The apparatus according to claim 16, wherein said means for separating and for positioning locates each of said containers so that the center of said container is off-set from the center of said extruder opening, the direction of off-set of said container being in the direction of movement of said container by said severing means so that the fill depth of ice cream in the leading side of the container as the container is moved away from the extruder opening is less than the depth of the container and is less than the fill depth in the remainder of the container.

* * * * *